US010458419B2

(12) United States Patent
Wang

(10) Patent No.: US 10,458,419 B2
(45) Date of Patent: Oct. 29, 2019

(54) TRANSMISSION DEVICE OF FAN

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 352 days.

(21) Appl. No.: 15/446,974

(22) Filed: Mar. 1, 2017

(65) Prior Publication Data

US 2018/0252225 A1 Sep. 6, 2018

(51) Int. Cl.
*F04D 25/08* (2006.01)
*F04D 25/10* (2006.01)

(52) U.S. Cl.
CPC ..... *F04D 25/088* (2013.01); *F04D 25/105* (2013.01); *F05D 2260/52* (2013.01); *F05D 2260/53* (2013.01)

(58) Field of Classification Search
CPC ..... F04D 25/105; F04D 25/088; F04D 25/10; F04D 19/002; F04D 29/4226; F16H 21/40
See application file for complete search history.

(56) References Cited

U.S. PATENT DOCUMENTS

| | | | | |
|---|---|---|---|---|
| 2,746,673 | A * | 5/1956 | Collins | F04D 25/105 74/411.5 |
| 5,126,609 | A * | 6/1992 | Shimono | F16H 57/023 310/401 |
| 6,537,029 | B1 * | 3/2003 | Chen-Lung | F04D 25/105 416/169 R |
| 8,186,941 | B2 * | 5/2012 | Lai | F04D 25/105 415/126 |
| 9,702,369 | B2 * | 7/2017 | Lee | F04D 25/105 |
| 2006/0196872 | A1 * | 9/2006 | Yan | F04D 25/105 219/753 |
| 2017/0268357 | A1 * | 9/2017 | Torres | F01D 9/042 |

* cited by examiner

*Primary Examiner* — Dwayne J White
*Assistant Examiner* — Jackson N Gillenwaters
(74) *Attorney, Agent, or Firm* — Sinorica, LLC

(57) ABSTRACT

A transmission device of a fan is provided. A central axis and an eccentric position of the transmission device are connected with a spindle and a connecting rod, respectively. The spindle is connected with a motor through gears. A first casing and a second casing of the transmission device are pivotally connected to each other. An accommodation hole of the second casing is provided with an elastic member and a press member to engage with an engaging recess of the first casing, such that the fan can be swung. When the user applies a force to change the angle of the fan, the press member is pressed by two press portions of the first casing to disengage from the engaging recess, such that the second casing can be turned relative to the first casing to prevent gear slipping or gear jumping of the motor, the gears, and the spindle.

9 Claims, 9 Drawing Sheets

TRANSMISSION DEVICE OF FAN

FIELD OF THE INVENTION

The present invention relates to a transmission device, and more particularly to a transmission device of a fan.

BACKGROUND OF THE INVENTION

FIG. 1 is a partial sectional view of a conventional transmission device of a fan. The fan comprises a fan main body 1. The fan main body 1 is provided with a geared motor 2 therein. The fan main body 1 is pivotally connected to one end of a main rod 4 through at least one pivot member 3 so that the fan main body 1 is rotatable relative the main rod 4 and formed with a swing direction. The geared motor 2 is connected with a spindle 6 through at least one gear 5 and is fixed to the central axis of a transmission member 7 through the spindle 6. An eccentric position of the transmission member 7 is connected with a connecting rod 8. The transmission member 7 is connected with the main rod 4 through the connecting rod 8 and the pivot member 3. When the fan is assembled, the other end of the main rod 4 is fixed to a wall or a ceiling. When the fan is activated, the fan main body 1 can be swung back and forth in the swing direction by the driving of the geared motor 2.

The conventional fan can be swung back and forth through the transmission member 7. When the user wants to change the angle of the fan main body 1, the fan main body 1 is usually pulled by hand to forcibly turn the fan body 1. However, the fan main body 1 is connected to the transmission member 7 through the geared motor 2, the gear 5, and the spindle 6. When the user applies a force to pull the fan main body 1 for changing the angle of the fan main body 1 in the swing direction, the applied force exerted by the user indirectly affects the geared motor 2, the gear 5, and the spindle 6. The geared motor 2, the gear 5 and the spindle 6 may have gear slipping or gear jumping easily. After a long time, the clearance between the geared motor 2, the gear 5 and the spindle 6 may increase. Accordingly, the inventor of the present invention has devoted himself based on his many years of practical experiences to solve these problems.

SUMMARY OF THE INVENTION

The primary object of the present invention is to provide a transmission device of a fan. When the fan is swung back and forth, the power of the motor is stably transmitted to the fan so that the fan can be swung swinging back and forth. When the user applies a force to the fan and the transmission device, the transmission device can prevent gear slipping or gear jumping of the related power transmission parts, such as a motor, a gear, and a spindle.

In order to achieve the aforesaid object, a transmission device of a fan is provided. The fan comprises a motor for swinging the fan back and forth and a connecting rod for swinging the fan back and forth. The motor is connected with a spindle through at least one gear. The spindle is fixedly connected to a central axis of the transmission device. The connecting rod is connected to an eccentric position of the transmission device, enabling the fan to be swung back and forth in a swing direction by the driving of the motor. The transmission device comprises a first casing, a second casing, at least one elastic member, and at least one press member. The first casing has a first annular surface corresponding to an axial direction of the spindle. The first annular surface of the first casing is provided with a plurality of spaced and raised press portions and an engaging recess formed between every adjacent two of the press portions. The second casing is pivotally connected to the first casing. The second casing has a second annular surface corresponding to the first annular surface of the first casing. The second annular surface is formed with at least one accommodation hole corresponding to the engaging recess. The elastic member is disposed in the accommodation hole of the second casing. The press member is disposed in the accommodation hole of the second casing. When the fan is swung back and forth, the press member is biased by the elastic member so that one end of the press member is exposed out of the accommodation hole to engage with the engaging recess of the first casing. The press member can be disengaged from the engaging recess of the first casing by an applied force from the adjacent two press portions, the applied force is at least equal to a force exerted by a user to change the angle of the fan in the swing direction.

Thereby, when the fan is swung back and forth, through the press member to engage with the engaging recess of the first casing, the first casing and the second casing of the transmission device are engaged with each other and cannot be turned, so that the transmission device provides a stable power to swing the fan back and forth. When the user applies a force to change the angle of the fan in the swing direction, the press member is pressed by the adjacent two press portions to compress the elastic member so that the press member disengages from the engaging recess of the first casing to enter the accommodation hole for turning the second casing relative to the first casing. The external force exerted by the user can be separated to prevent gear slipping or gear jumping of the motor, the gear, and the spindle.

DETAILED DESCRIPTION OF THE PREFERRED EMBODIMENTS

Figure 1:
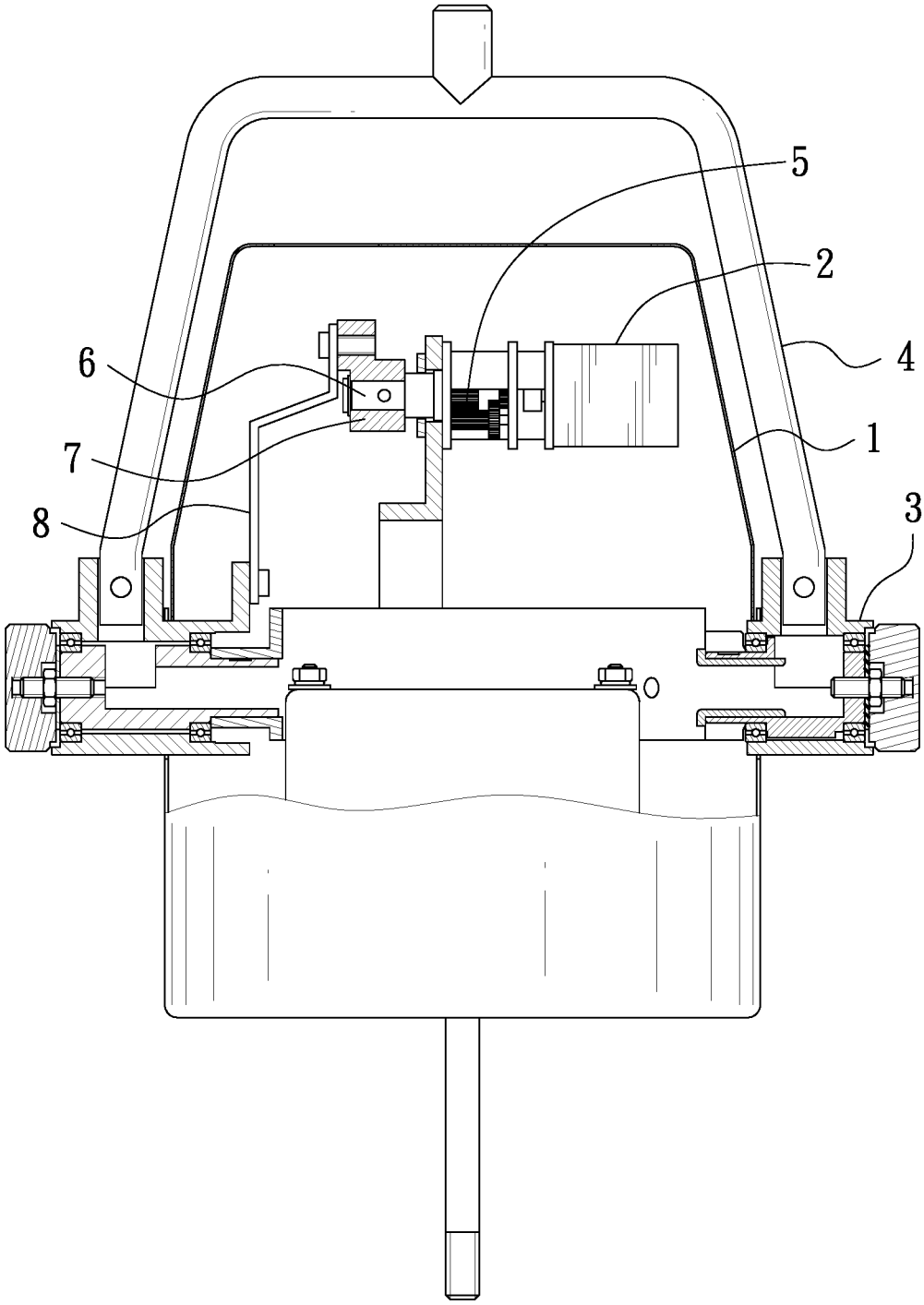
FIG. 1 PRIOR ART
FIG. 1 is a partial sectional view of a conventional transmission device of a fan.
Figure 2:
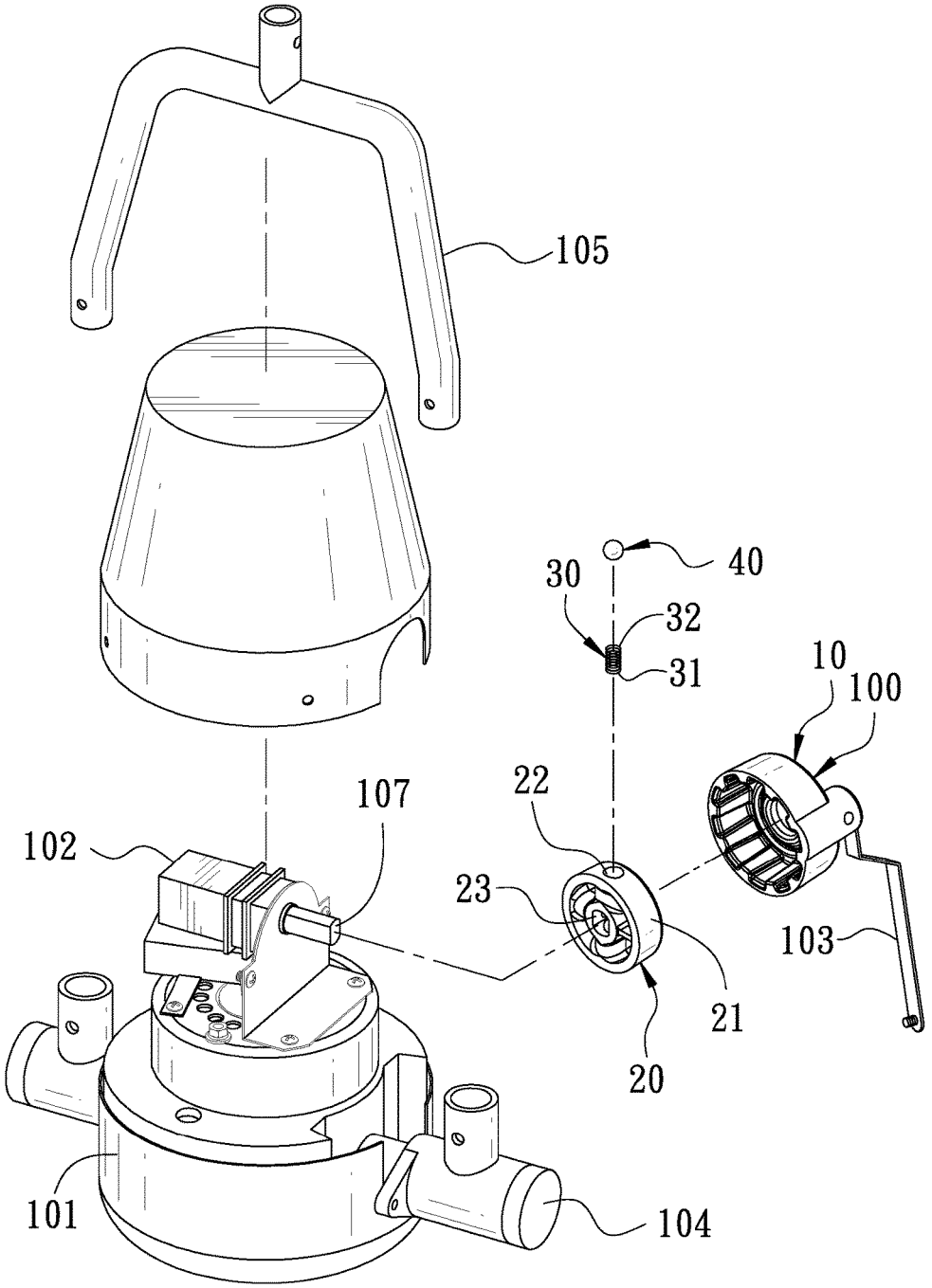
FIG. 2 is an exploded view in accordance with a preferred embodiment of the present invention.
Figure 3:
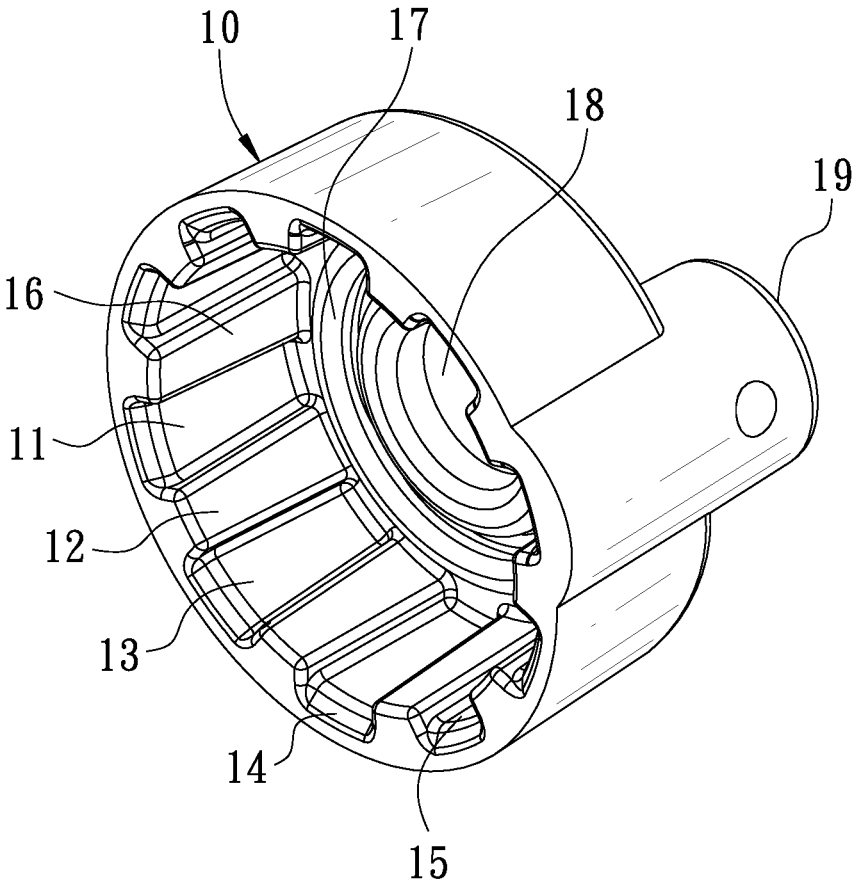
FIG. 3 is a perspective view of a first casing in accordance with the preferred embodiment of the present invention.
Figure 4:
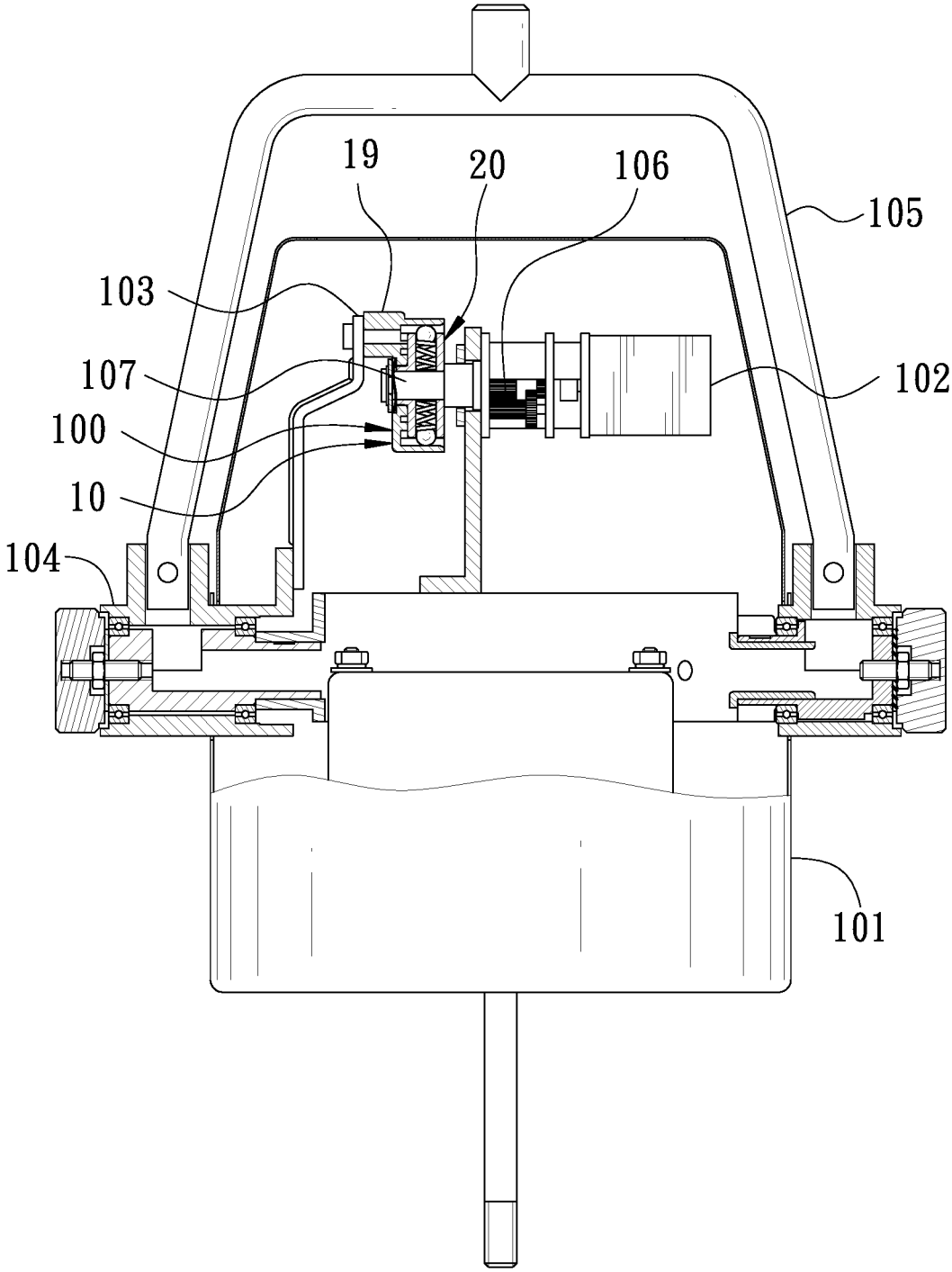
FIG. 4 is a partial sectional view in accordance with the preferred embodiment of the present invention.
Figure 5:
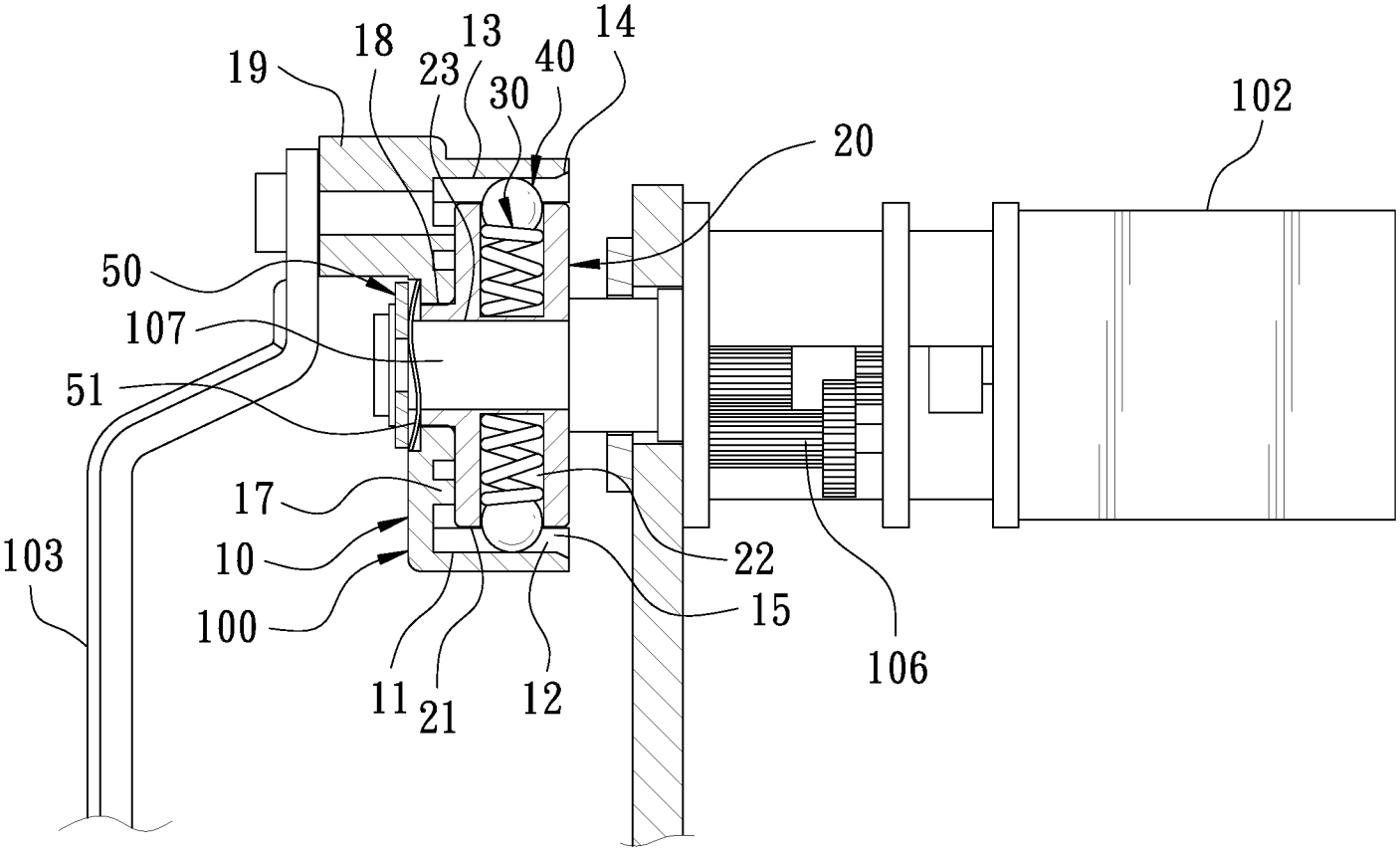
FIG. 5 is a partial enlarged sectional view of a transmission device in accordance with the preferred embodiment of the present invention.

Embodiments of the present invention will now be described, by way of example only, with reference to the accompanying drawings.

Referring to FIG. 2 through FIG. 9, the present invention discloses a transmission device 100 of a fan 101. In a preferred embodiment, the fan 101 comprises a motor 102 for swinging the fan 101 back and forth and a connecting rod 103 for swinging the fan 101 back and forth. The motor 102 is fixed in the fan 101. The fan 101 is pivotally connected to one end of a main rod 105 through two pivot members 104, and another end of the main rod 105 is fixed to a wall or a ceiling, such that the fan 101 is rotatable relative to the main rod 105 and formed with a swing direction. The motor 102 is connected with a spindle 107 through a plurality of gears 106. The spindle 107 is fixedly connected to a central axis of the transmission device 100. Two ends of the connecting rod 103 are connected to an eccentric position of the transmission device 100 and the main rod 105, respectively. The connecting rod 103 is connected with the main rod 105 through one of the pivot members 104 so that the fan 101 can be swung back and forth in the swing direction by the driving of the motor 102. However, this is only one embodiment, not limiting the practicable embodiments of the present invention. The transmission device 100 of the present invention comprises a first casing 10, a second casing 20, two elastic members 30, two press members 40, and a fastener 50.

The first casing 10 has a first annular surface 11 corresponding to an axial direction of the spindle 107. The first annular surface 11 is disposed on an inner wall of the first casing 10. The first annular surface 11 of the first casing 10 is provided with a plurality of spaced and raised press portions 12 and engaging recesses 13 each formed between every adjacent two of the press portions 12. An outer edge of each engaging recess 13 is provided with a chamfer 14. One side of the first casing 10 is provided with an opening 15, so that the first casing 10 is formed with an accommodation space 16 between the first annular surface 11 and the opening 15. An inner wall of another side of the first casing 10 is provided with at least two spaced ribs 17. The first casing 10 is provided with a first axial hole 18 corresponding to the spindle 107. The spindle 107 is pivotally connected to the first axial hole 18. The eccentric position of the first casing 10 is provided with a drive wheel 19 protruding outwardly for connecting the connecting rod 103.

The second casing 20 is disposed in the accommodation space 16 of the first casing 10. The second casing 20 is pivotally connected to the first casing 10. The second casing 20 has a second annular surface 21 corresponding to the first annular surface 11 of the first casing 10. The second annular surface 21 is disposed on an outer wall of the second casing 20. The second annular surface 21 is formed with two accommodation holes 22 corresponding to the engaging recesses 13. The second casing 20 is provided with a second axial hole 23 corresponding to the spindle 107. The spindle 107 is fixed to the second axial hole 23. An outer wall of one side of the second axial hole 23 is pivotally connected to the first axial hole 18 of the first casing 10. The ribs 17 are annularly disposed between the first casing 10 and the second casing 20 for reducing the friction between the first casing 10 and the second casing 20. Furthermore, a lubricant may be provided between the ribs 17 to reduce the friction between the first casing 10 and the second casing 20, and the ribs 17 are configured to prevent the lubricant from leaking. This reduces the influence of an external force on the motor 102 and prevents gear slipping or gear jumping of the gears 106 and the spindle 107.

The two elastic members 30 are disposed in the accommodation holes 22, respectively. One end 31 of the elastic member 30 is pressed against the bottom of the corresponding accommodation hole 22.

The two press members 40 are disposed in the accommodation holes 22, respectively. When the fan 101 is swung back and forth, the press member 40 is biased by the other end 32 of the corresponding elastic member 30, such that one end 41 of the press member 40 is exposed out of the corresponding accommodation hole 22 to engage with the corresponding engaging recess 13 of the first casing 10. Furthermore, the press member 40 may be disengaged from the corresponding engaging recess 13 of the first casing 10 by an applied force from the adjacent two press portions 12. The applied force is at least equal to the force exerted by the user to change the angle of the fan 101 in the swing direction. The press members 40 are spheres. When the transmission device 100 is assembled, through the chamfer 14 of the engaging recess 13, the press member 40 is mounted between the corresponding engaging recess 13 of the first casing 10 and the corresponding accommodation hole 22 of the second casing 20 more easily.

The fastener 50 is slightly greater than the first axial hole 18 of the first casing 10 to secure the spindle 107. The fastener 50 is disposed at an outer side of the first casing 10. An elastic element 51 is provided between the fastener 50 and the first casing 10. In the preferred embodiment of the present invention, the fastener 50 is a C-shaped buckle. The elastic member 51 is a wavy washer.

Figure 6:
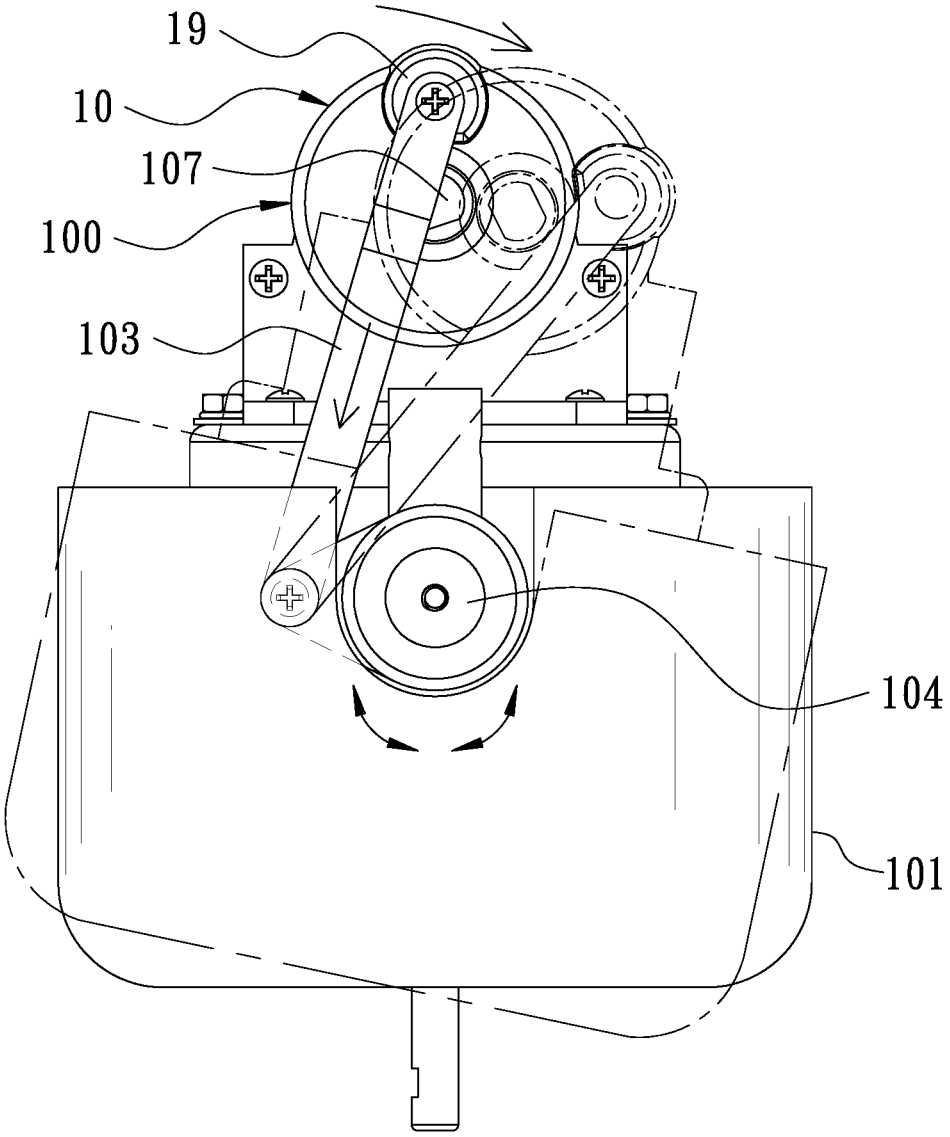
FIG. 6 is a schematic view of the preferred embodiment of the present invention when in use, showing a fan to be swung back and forth.

Referring to FIG. 2 to FIG. 6, when the fan 101 is actuated, the motor 102 of the fan 101 generates a power, and the power is sequentially transmitted from the motor 102 to the gears 106 and the transmission device 100 to drive the transmission device 100 to turn. Through the drive wheel 19 of the transmission device 100, the transmission device 100 drives the connecting rod 103 to swing back and forth so that the fan 101 reciprocates in the swing direction relative to the main rod 105. FIG. 6 is a schematic view of the preferred embodiment of the present invention when in use, showing the fan to be swung back and forth.

Figure 7:
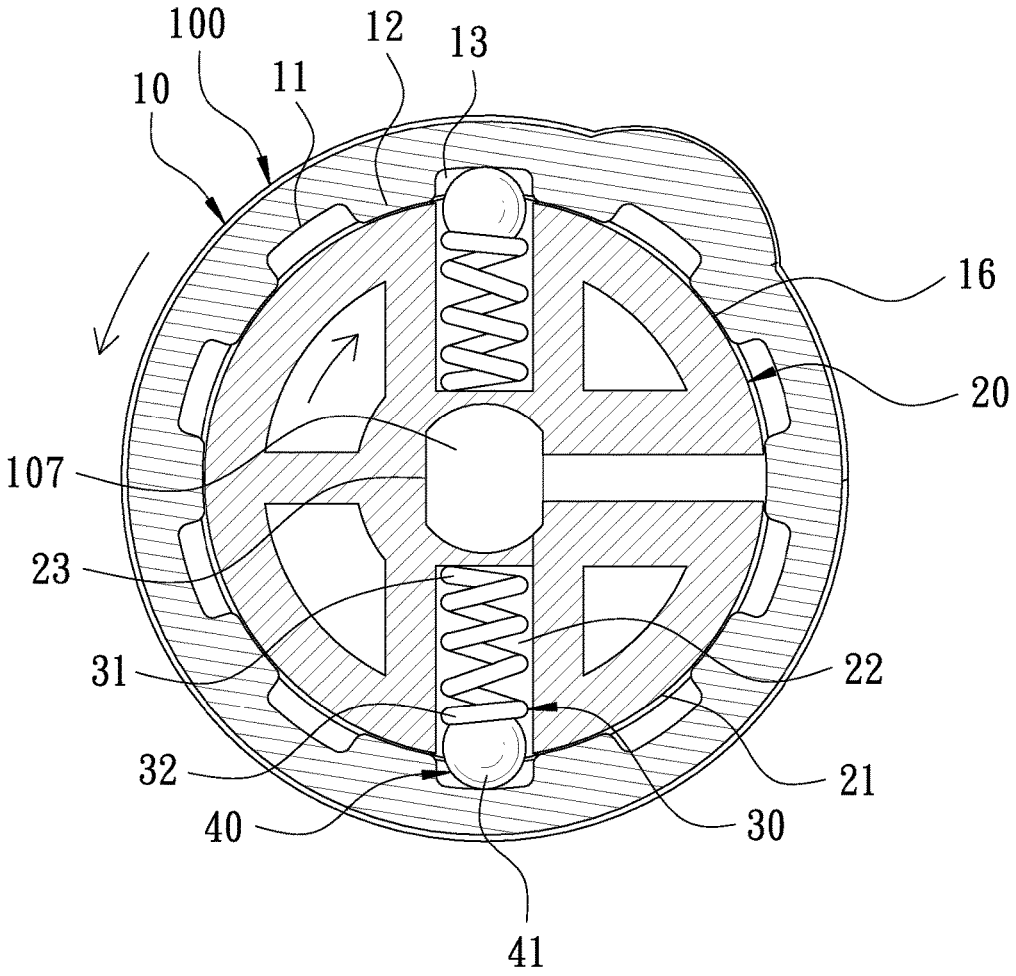
FIG. 7 is a schematic view of the preferred embodiment of the present invention when in use, showing the transmission device not applied with an external force when the fan is swung back and forth.

FIG. 7 is a schematic view of the preferred embodiment of the present invention when in use, showing the transmission device 100 not applied with an external force when the fan is swung back and forth. When the fan 101 is swung, the transmission device 100 is driven by the spindle 107 to turn continuously. The press member 40 is biased by the other end 32 of the corresponding elastic member 30, such that the end 41 of the press member 40 is exposed out of the corresponding accommodation hole 22 to engage with the corresponding engaging recess 13 of the first casing 10. The engaging recess 13 is formed between every adjacent two of the press portions 12. Thereby, when the fan 101 is swung, the first casing 10 and the second casing 20 of the transmission device 100 cannot be turned each other through the press members 40 to engage with the engaging recesses 13 of the first casing 10 and the press portions 12, such that the transmission device 100 provides a stable power to swing the fan 101 back and forth.

Figure 8:
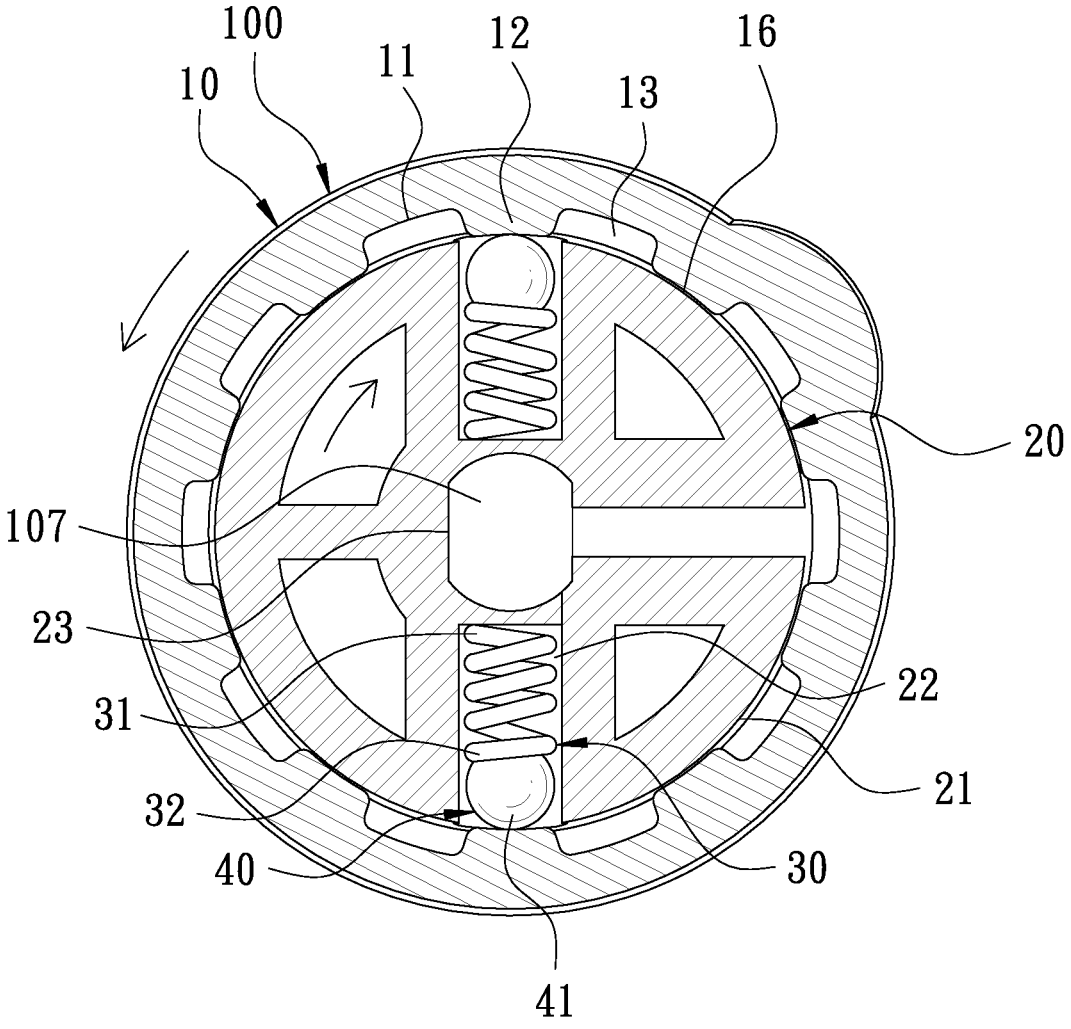
FIG. 8 is a schematic view of the preferred embodiment of the present invention when in use, showing the turning state of the first casing and the second casing of the transmission device.

FIG. 7 and FIG. 8 are schematic views of the preferred embodiment of the present invention when in use. FIG. 8 illustrates the turning state of the first casing 10 and the second casing 20 of the transmission device 100. When the fan 101 is pulled by the user's hand to change the angle of the fan 101 in the swing direction, an external force is applied to the fan 101. The external force is transmitted to the second casing 20 of the transmission device 100 via the fan 101, the motor 102, the gears 106 and the spindle 107 so that the second casing 20 can be turned relative to first casing 10, meanwhile, the press members 40 are pressed by the adjacent press portions 12 to compress the elastic members 30, such that the press members 40 disengage from the engaging recesses 13 of the first casing 10 to enter the accommodation holes 22 for turning the second casing 20 relative to the first casing 10. When the user forcibly changes the angle of the fan 101 in the swing direction, the second casing 20 of the transmission device 100 can be turned relative to the first casing 10 to separate the external force exerted by the user so as to prevent gear slipping or gear jumping of the motor 102, the gears 106, and the spindle 107.

Figure 9:
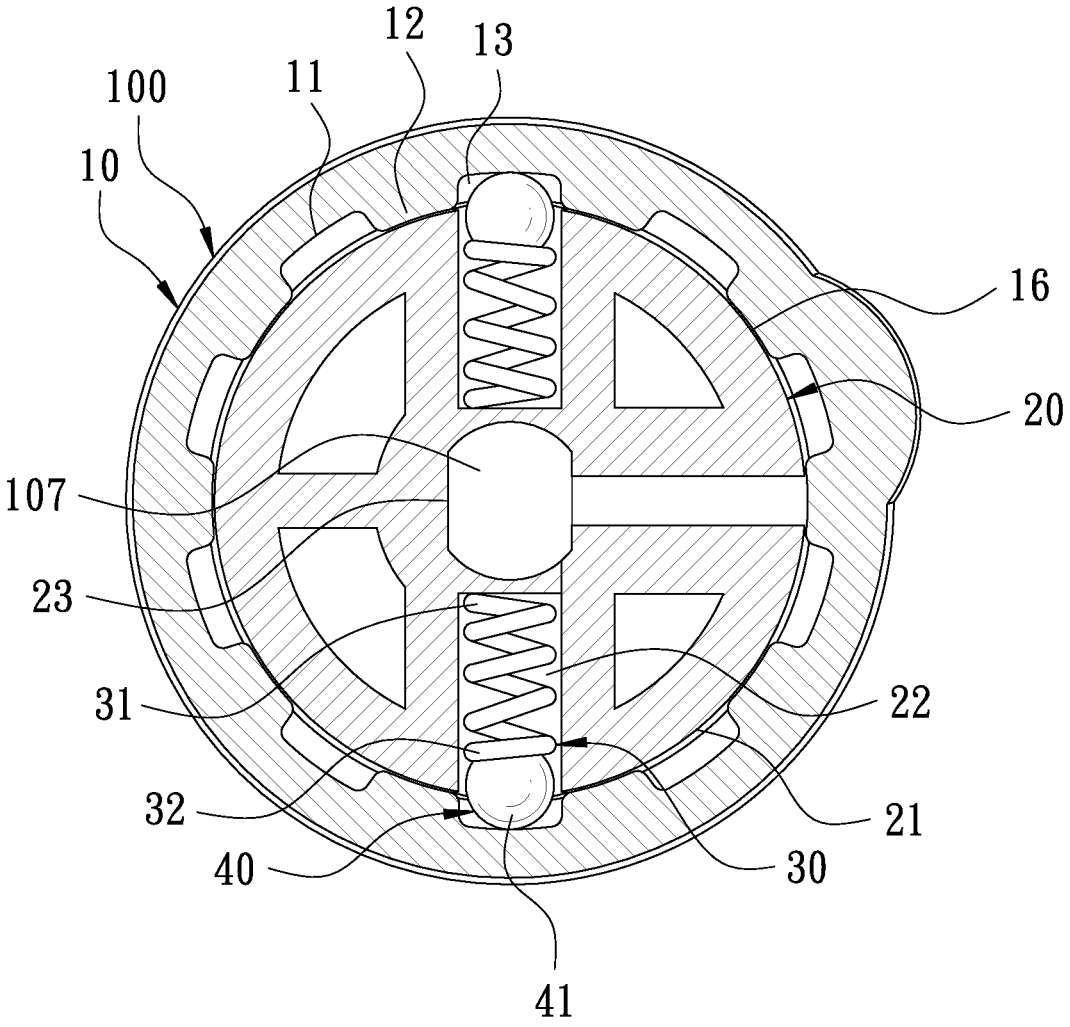
FIG. 9 is a schematic view of the preferred embodiment of the present invention when in use, showing the state of the first casing and the second casing of the transmission device after being turned.

FIG. 9 is a schematic view of the preferred embodiment of the present invention when in use, showing the state of the first casing 10 and the second casing 20 of the transmission device 100 after being turned. After the angle of the fan 101 is changed, the press member 40 is biased by the other end 32 of the corresponding elastic member 30 to engage with the corresponding engaging recess 13 of the first casing 10, so that the transmission device 100 provides a stable power to swing the fan 101 back and forth.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A transmission device of a fan, the fan comprising a motor for swinging the fan back and forth and a connecting rod for swinging the fan back and forth, the motor being connected with a spindle through at least one gear, the spindle being fixedly connected to a central axis of the transmission device, the connecting rod being connected to an eccentric position of the transmission device, enabling the fan to be swung back and forth in a swing direction by the motor, the transmission device comprising:

a first casing, having a first annular surface corresponding to an axial direction of the spindle, the first annular surface of the first casing being provided with a plurality of spaced and raised press portions and an engaging recess formed between every adjacent two of the press portions;

a second casing, pivotally connected to the first casing, the second casing having a second annular surface corresponding to the first annular surface of the first casing, the second annular surface being formed with at least one accommodation hole corresponding to the engaging recess;

at least one elastic member, disposed in the accommodation hole of the second casing; and at least one press member, disposed in the accommodation hole of the second casing;

wherein when the fan is swung back and forth, the press member is biased by the elastic member so that one end of the press member is exposed out of the accommodation hole to engage with the engaging recess of the first casing, wherein the press member can be disengaged from the engaging recess of the first casing by an applied force from the adjacent two press portions, the applied force is at least equal to a force exerted by a user to change the angle of the fan in the swing direction, wherein the first casing is provided with a first axial hole corresponding to the spindle, the spindle is pivotally connected to the first axial hole, the second casing is provided with a second axial hole corresponding to the spindle, and the spindle is fixed to the second axial hole.

2. The transmission device of a fan as claimed in claim 1, wherein the first annular surface is disposed on an inner wall of the first casing, one side of the first casing is provided with an opening, the first casing is formed with an accommodation space between the first annular surface and the opening, the second annular surface is disposed on an outer wall of the second casing, and the second casing is disposed in the accommodation space of the first casing.

3. The transmission device of a fan as claimed in claim 2, wherein an inner wall of another side of the first casing is provided with at least two spaced ribs, and the ribs are located between the first casing and the second casing.

4. The transmission device of a fan as claimed in claim 1, wherein an outer wall of one side of the second axial hole is pivotally connected to the first axial hole of the first casing.

5. The transmission device of a fan as claimed in claim 1, further comprising a fastener, the fastener being wider than the first axial hole of the first casing to secure the spindle, the fastener being disposed at an outer side of the first casing, and an elastic element being provided between the fastener and the first casing.

6. The transmission device of a fan as claimed in claim 1, wherein the eccentric position of the first casing is provided with a drive wheel protruding outwardly for connecting the connecting rod.

7. The transmission device of a fan as claimed in claim 1, wherein an outer edge of the engaging recess is provided with a chamfer.

8. The transmission device of a fan as claimed in claim 1, wherein the press member is a sphere.

9. The transmission device of a fan as claimed in claim 1, wherein one end of the elastic member is pressed against a bottom of the accommodation hole, when the fan is swung back and forth, the press member is biased by another end of the elastic member.

* * * * *